US005788260A

United States Patent [19]

Huang

[11] Patent Number: 5,788,260

[45] Date of Patent: Aug. 4, 1998

[54] LUGGAGE CARRIER

[76] Inventor: Shih-Lung Huang, 28, Alley 28, Lane 150, Hai Tien Road, Sec. 2, Tainan, Taiwan

[21] Appl. No.: 768,268

[22] Filed: Dec. 17, 1996

[51] Int. Cl.[6] ..... B62B 1/12

[52] U.S. Cl. ..... 280/645; 280/654; 280/655; 280/47.2

[58] Field of Search ..... 280/37, 40, 42, 280/641, 642, 645, 646, 652, 654, 655, 47.26, 47.315, 47.2; 190/18 A

[56] References Cited

U.S. PATENT DOCUMENTS

| | | | |
|---|---|---|---|
| 4,314,624 | 2/1982 | Royet | 280/37 X |
| 4,887,835 | 12/1989 | Dallaire et al. | 280/655 X |
| 5,071,146 | 12/1991 | Lewis et al. | 280/643 X |
| 5,207,439 | 5/1993 | Mortenson | 280/47.2 |
| 5,519,919 | 5/1996 | Lee | 280/47.2 X |
| 5,568,848 | 10/1996 | Liang | 280/37 X |

*Primary Examiner*—Brian L. Johnson
*Assistant Examiner*—Michael Mar
*Attorney, Agent, or Firm*—Pro-Techtor International

[57] ABSTRACT

A luggage carrier including two wheel-supported sleeves fastened to a back side of a luggage, a retractable handle coupled to the sleeves, two wheel-supported back support bars respectively pivoted to the top ends of the sleeves, and two links coupled between the back support bars and the two opposite ends of the handle to extend out the back support bars when the handle is pulled out of the sleeves, or to pull back the back support bars when the handle is collapsed, each link having one end pivoted to one back support bar, and an opposite end pivoted to one end of the handle and moved along a longitudinal slot in one sleeve.

1 Claim, 6 Drawing Sheets

LUGGAGE CARRIER

BACKGROUND OF THE INVENTION

The present invention relates to luggage carriers, and more particularly to such a luggage carrier which has collapsible wheel-supported back support bars for supporting the luggage carrier in the operative position.

When traveling, one may have to carry several travel bags or luggage. A variety of luggage carriers have been disclosed for carrying luggage with less effort, and have appeared on the market. FIG. 1 shows a conventional luggage carrier 200 for carrying a luggage 100. This luggage carrier 200 is equipped with wheels 300, and fastened to the back side of the luggage 100. When the luggage carrier 200 is pulled forwards, an obliquely upward force F is employed to the luggage carrier 200 through the user's arm. This obliquely upward force F produces a vertical component of force F1 and a horizontal component of force F2. The vertical component of force F1 bears the weight W of the luggage 100. The horizontal component of force F2 carries the luggage 100 forwards. This luggage carrier is compact, and convenient in use. However, because the vertical component of force F1 is acted against the weight W of the luggage 100, only the horizontal component of force F2 is utilized to pull the luggage 100. Therefore, the muscles of the arms ache quickly from overexertion.

SUMMARY OF THE INVENTION

The present invention has been accomplished to provide a luggage carrier which eliminates the aforesaid problem. According to the present invention, the luggage carrier comprises two wheel-supported sleeves fastened to a back side of a luggage, a retractable handle coupled to the sleeves, two wheel-supported back support bars respectively pivoted to the top ends of the sleeves, and two links coupled between the back support bars and the two opposite ends of the retractable handle to extend out the back support bars when the retractable handle is pulled out of the sleeves, or to pull back the wheel-supported back support bars when the handle is collapsed. Because the wheel-supported back support bars are linked to the retractable handle, the wheel-supported back support bars are automatically extended out when the retractable handle is pulled out of the sleeves. Therefore, the operation of the present invention is easy. Furthermore, because the sleeves and the back support bars are supported on the respective wheels, the pulling force of the user is fully utilized to pull the luggage, i.e., less effort is needed to pull the luggage.

DETAILED DESCRIPTION OF THE PREFERRED EMBODIMENT

Figure 1:
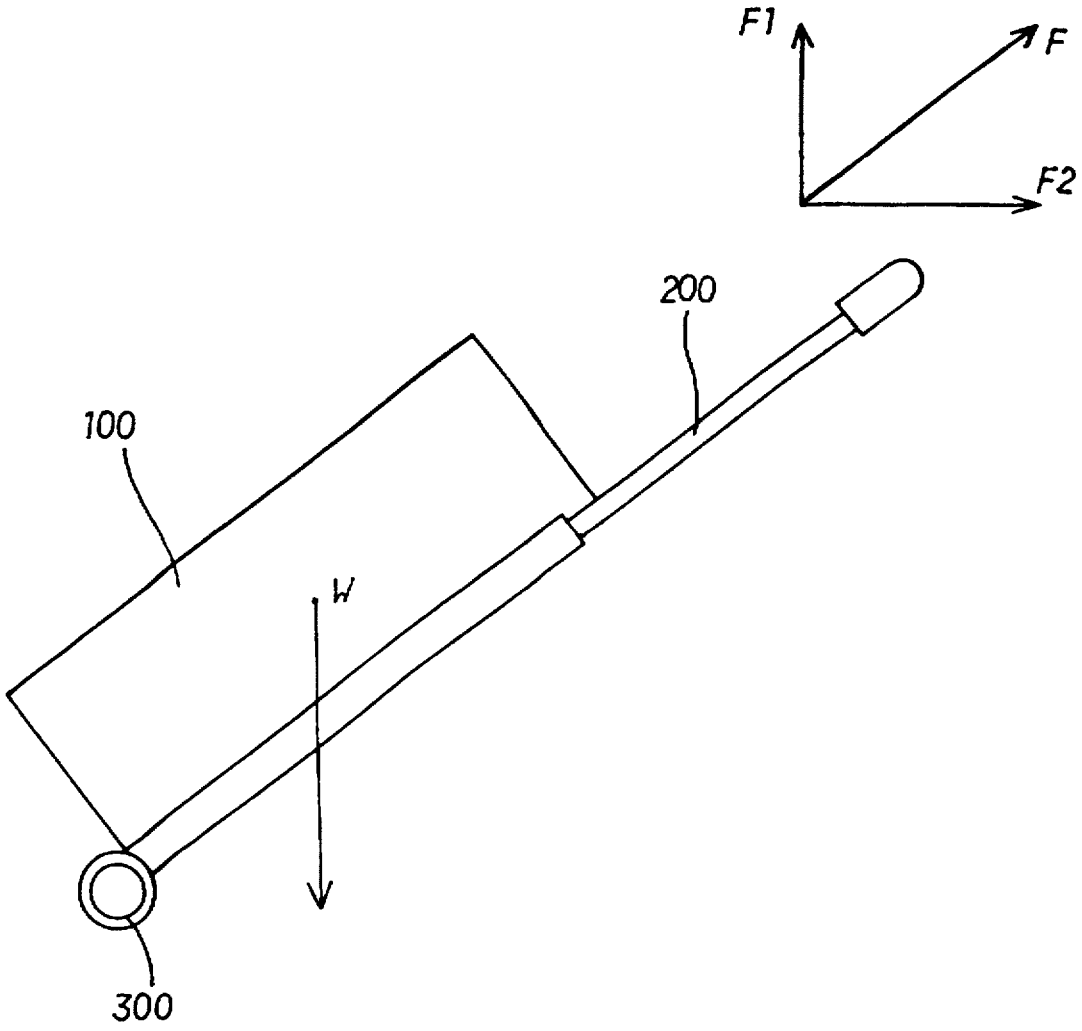
FIG. 1 (Prior Art)
FIG. 1 is a plain view of a luggage carrier according to the prior art, showing the directions of components of force.
Figure 2:
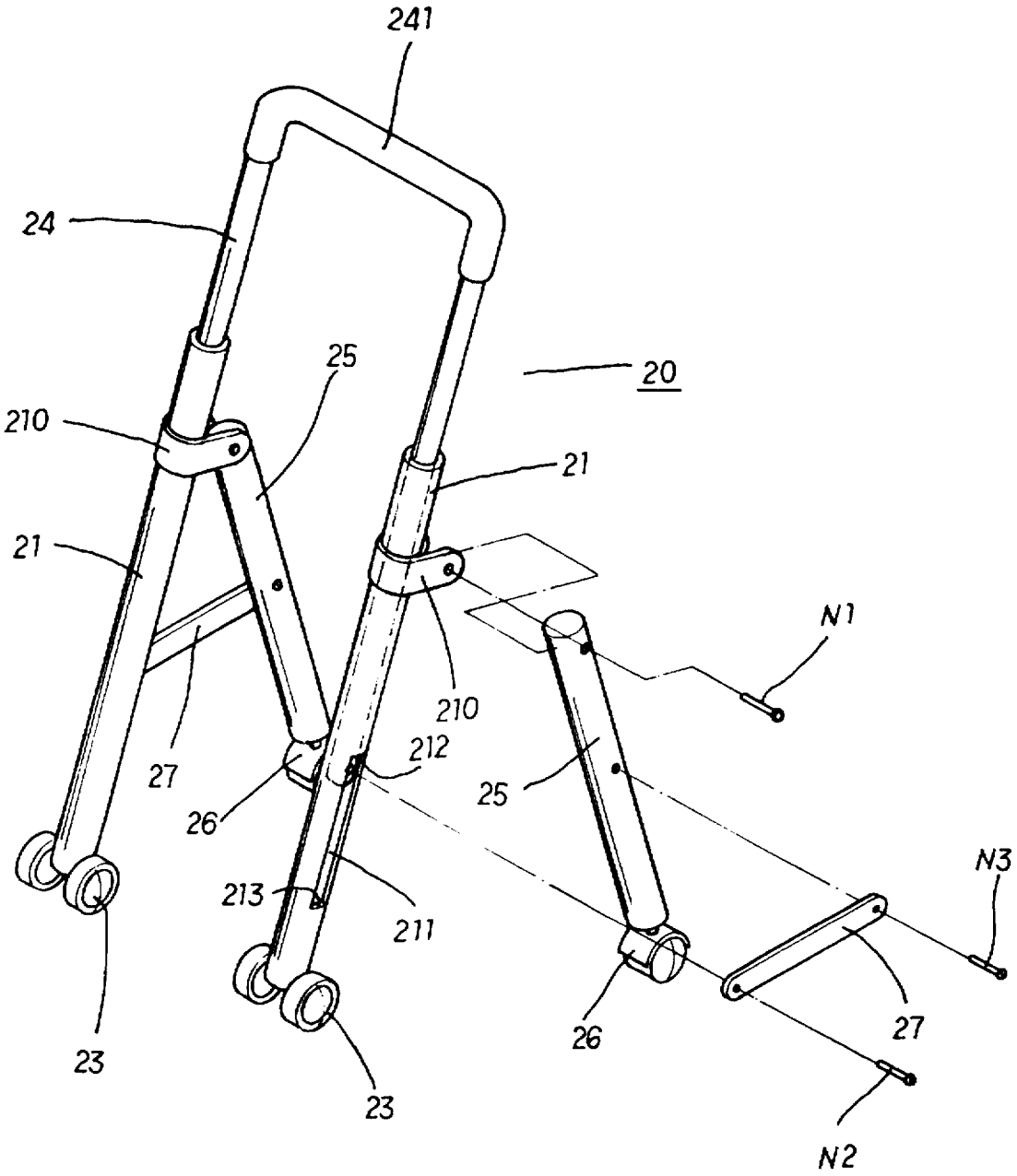
FIG. 2 is an exploded view of a luggage carrier according to the present invention.
Figure 3:
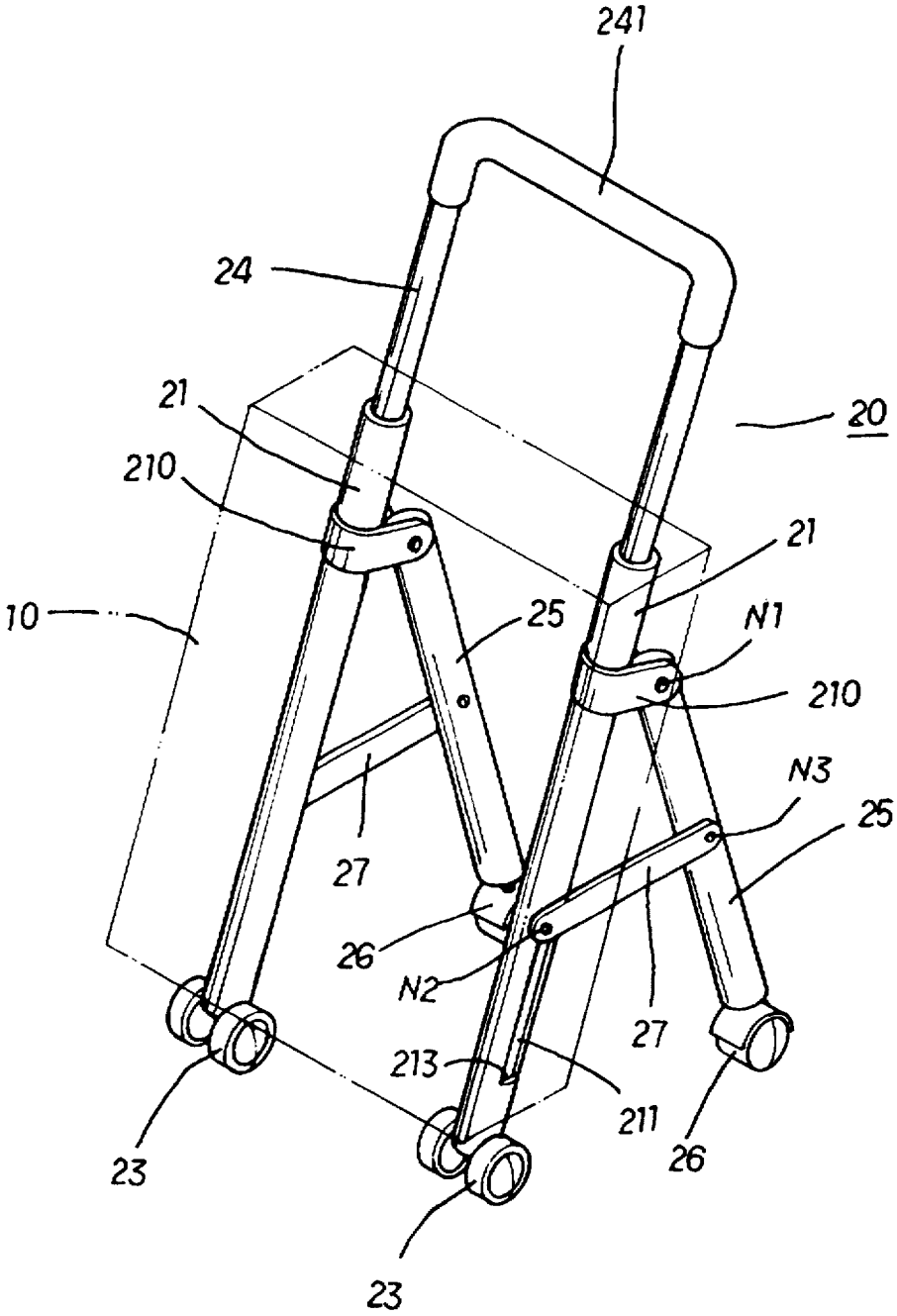
FIG. 3 is a perspective view of the present invention, showing the luggage carrier fastened to a luggage and extended out.
Figure 4:
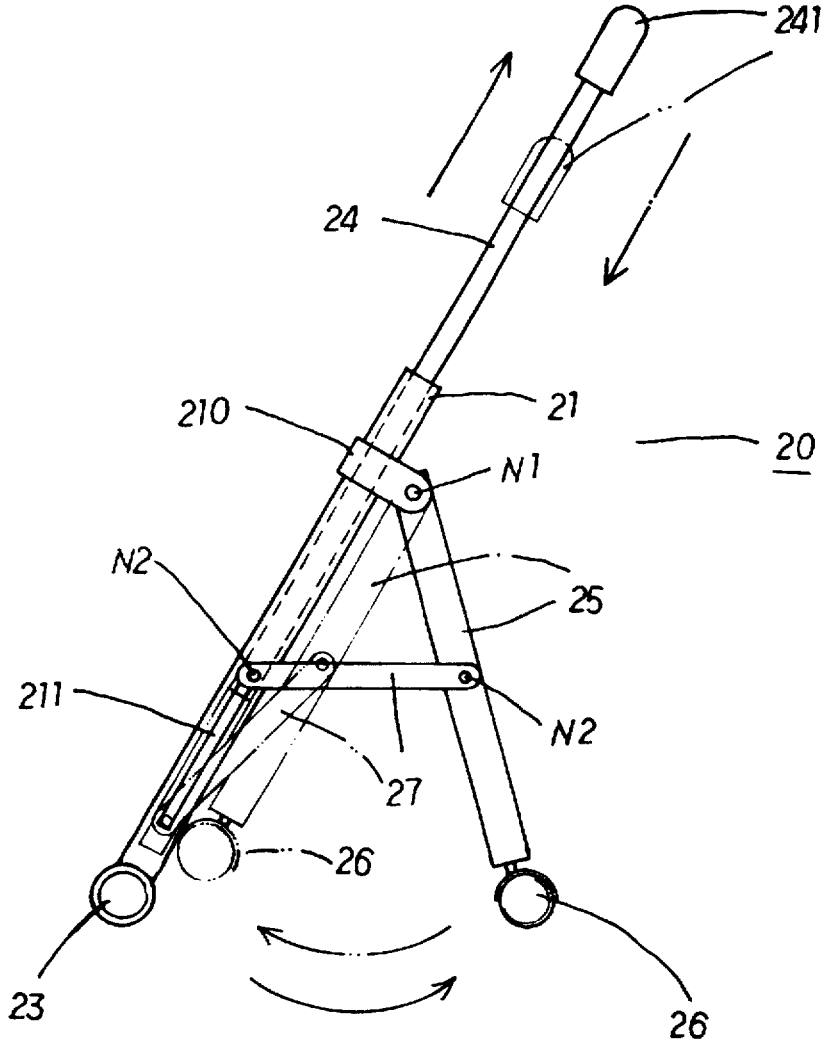
FIG. 4 is an applied view of the present invention, showing the luggage carrier moved between the extended position and the collapsed position.

Referring to FIGS. 2, 3 and 4, a luggage carrier 20 comprises two parallel sleeves 21 fixedly secured to a back side of a luggage 10, two front wheels 23 respectively mounted on the parallel sleeves 21 at the bottom to make the luggage carrier easy to move, and a substantially U-shaped retractable handle 24 having two opposite ends respectively and slidably inserted into the sleeves 21 from the top side (see FIG. 4). Lock means is provided to lock the retractable handle 24 in the operative position when the retractable handle 24 is extended out (this lock means can be achieved by conventional techniques and is not within the scope of the present invention, therefore it is not described in detail). The transverse top side of the retractable handle 24 forms hand grip 241. Two U-lugs 210 are respectively welded to the sleeves 21 near the top. Two back support bars 25 are provided having a respective top end respectively pivoted to the U-lugs 210 by a respective pivot N1, and a respective bottom end mounted with a respective rear wheel 26. Each of the sleeves 21 has a longitudinal slot 211 at an outer side. The longitudinal slot 211 has a top dead point 212, and a bottom dead point 213. Two links 27 are respectively coupled between the back support bars 25 and the handle 24. Each link 27 has one end pivoted to a middle part of one back support bar 25 by a pivot N3, and an opposite end pivoted to one end of the handle 24 by a pivot N2. The pivot N2 is inserted through the longitudinal slot 211 of one sleeve 21, and connected between the corresponding link 27 and one end of the handle 24.

Figure 5:
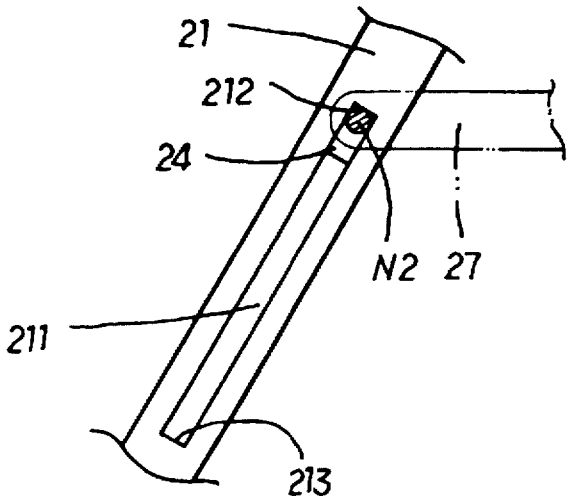
FIG. 5 is an enlarged view of a part of the present invention, showing the link moved to the top dead point in the longitudinal slot.
Figure 6:
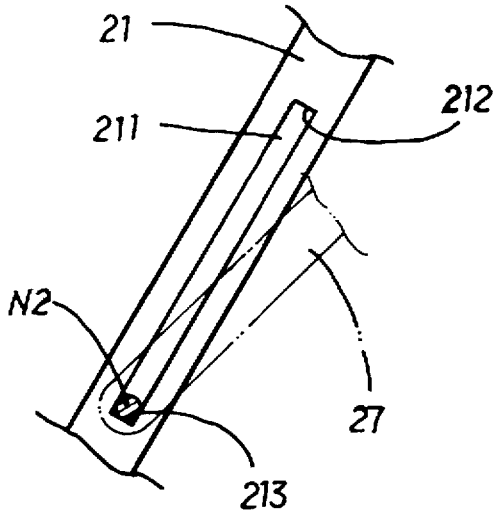
FIG. 6 is similar to FIG. 5 but showing the link moved to the bottom dead point in the longitudinal slot.

Referring to FIGS. 5 and 6, and FIGS. 2 and 3 again, when the handle 24 is extended out and locked in the operative position, the pivots N2 are respectively moved from the bottom dead points 213 of the respective longitudinal slots 211 to the top dead points 212 (see FIG. 5), and therefore the back support bars 25 are respectively moved by the links 27 to the extended position (see the real line in FIG. 4); on the contrary, when the handle 24 is received back, the pivots N2 are respectively moved from the top dead points 212 of the respective longitudinal slots 211 to the bottom dead points 213 (see FIG. 6), and therefore the back support bars 25 are pulled back and closely attached to the sleeves 21 (see the imaginary line in FIG. 4).

When in use, the handle 24 is pulled out of the sleeves 21 and locked in the operative position. When the handle 24 is locked in the operative position, the back support bars 25 are respectively retained in the extended position, and the luggage carrier is supported on the front wheels 23 and the rear wheels 26 (see FIG. 3). Thus, the luggage carrier 20 with the luggage 10 can be conveniently moved with less effort. When not in use, the luggage carrier 20 can be collapsed, and therefore less storage space is required.

Figure 7:
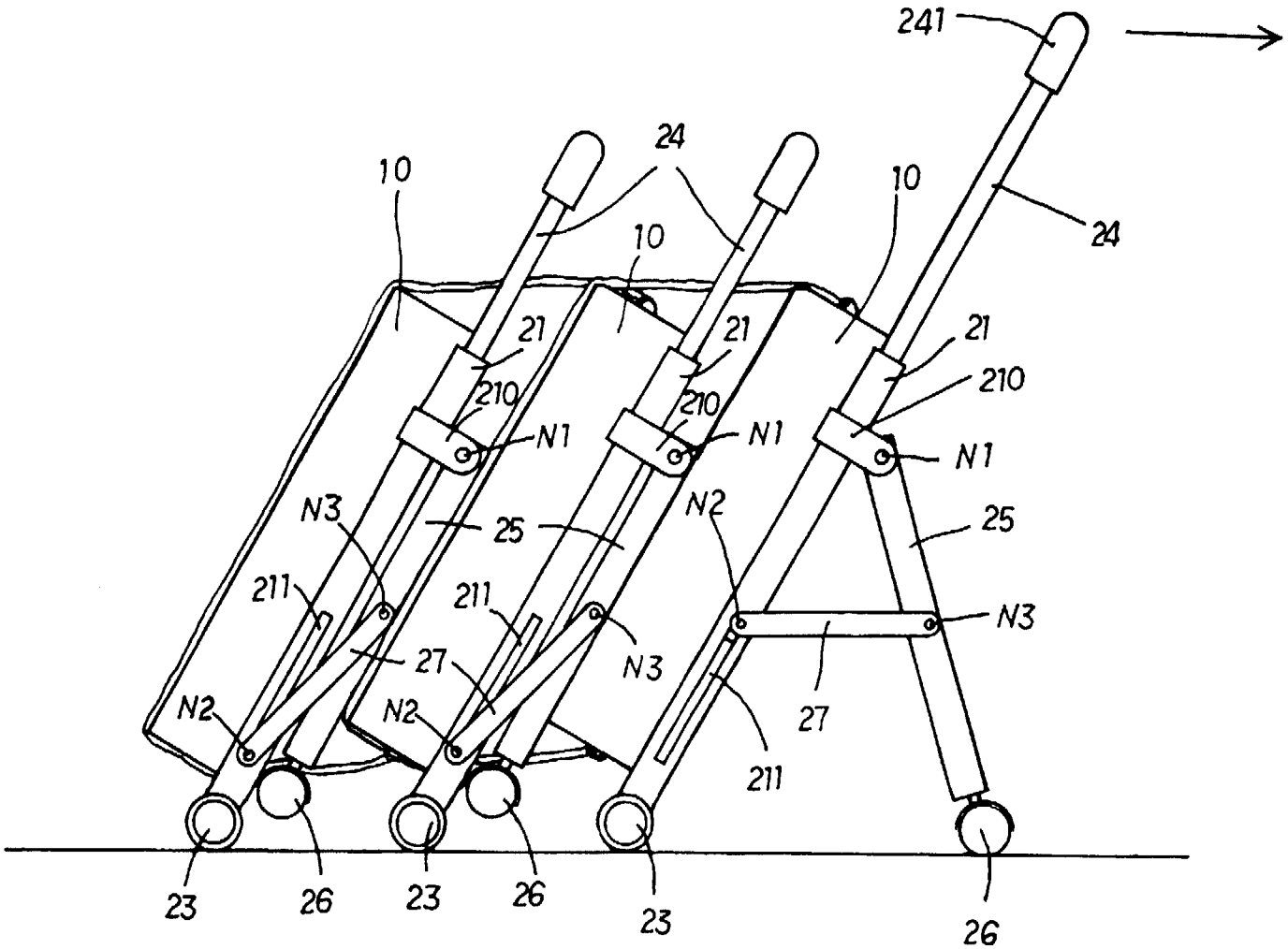
FIG. 7 shows an application example of the present invention.

Referring to FIG. 7, several luggage carriers may be fastened together by a rope or the like for carrying by hand with less effort.

While only one embodiment of the present invention has been shown and described, it will be understood that various modifications and changes could be made thereunto without departing from the spirit and scope of the invention disclosed.

What the invention claimed is:

1. A luggage carrier comprising two sleeves respectively fastened to a back side of a luggage and supported on a respective wheel, and a retractable handle having two opposite handle portions respectively and slidably coupled to said sleeves, wherein:

said sleeves have a respective longitudinal slot at an outer side, and a respective U-lug mounted on the outside of each sleeve and spaced above the respective longitudinal slot, the longitudinal slot of each of said sleeves having a top dead point and a bottom dead point;

two back support bars are respectively pivoted to said sleeves for supporting said sleeves, each of said back support bars having a top end pivoted to the U-lug of a respective sleeve, and a bottom end with a wheel mounted thereon;

two links are coupled between said back support bars and lower ends of the two opposite handle portions of said retractable handle, each of said link having one end pivoted to a middle part of one back support bar, and an opposite end pivoted to a lower end of each handle portion and movable along the longitudinal slot of each sleeve between the top dead point and bottom dead point of the respective longitudinal slot, the opposite ends of said links being moved to the top dead points of the longitudinal slots of said sleeves to pivot said back support bars rearwardly away from said sleeves when said handle portions are pulled out of said sleeves, and the opposite ends of said links being moved to the bottom dead points of the longitudinal slots of said sleeves to pivot said back support bars forwardly toward said sleeves when said handle portions are pushed back into said sleeves.

* * * * *